US006409622B1

(12) United States Patent
Bolz et al.

(10) Patent No.: US 6,409,622 B1
(45) Date of Patent: Jun. 25, 2002

(54) ELECTRIC MOTOR WITH DRIVE

(75) Inventors: Martin-Peter Bolz, Oberstenfeld; Ferdinand Grob, Besigheim; Stefan Tumback, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,089

(22) PCT Filed: Nov. 4, 1999

(86) PCT No.: PCT/DE99/03522

§ 371 (c)(1),
(2), (4) Date: Nov. 1, 2000

(87) PCT Pub. No.: WO00/29744

PCT Pub. Date: May 25, 2000

(30) Foreign Application Priority Data

Nov. 14, 1998 (DE) ..... 198 52 607
Jun. 16, 1999 (DE) ..... 199 27 521

(51) Int. Cl.[7] ..... F16H 3/62
(52) U.S. Cl. ..... 475/5; 475/290
(58) Field of Search ..... 475/5, 10, 149, 475/286, 290

(56) References Cited

U.S. PATENT DOCUMENTS 4,708,030 A * 11/1987 Cordner ..... 475/296
5,418,400 A * 5/1995 Stockton ..... 475/13
5,482,512 A * 1/1996 Stevenson ..... 475/5
5,730,675 A 3/1998 Yamaguchi ..... 475/2

FOREIGN PATENT DOCUMENTS

| | | |
|---|---|---|
| CH | 193 425 A | 1/1938 |
| DE | 25 04 867 A | 8/1976 |
| DE | 32 46 230 A | 6/1984 |
| EP | 0 384 808 A | 8/1990 |

OTHER PUBLICATIONS

Database WPI, Section PQ, Week 8508, Derwent Publications Ltd., London, GB, Class Q54, AN 048835, XP 002134432 & SU 1 103 008 A, Jul. 15, 1984.

* cited by examiner

*Primary Examiner*—Sherry Estremsky
(74) *Attorney, Agent, or Firm*—Michael J. Striker

(57) ABSTRACT

The synchronous or asynchronous electrical machine for an internal combustion engine can operate alternately in a starter mode during engine starting and a generator mode during engine operation in order to eliminate the need for a separate starter and generator. The electrical machine includes a two-stage planetary gear device coupled to a shaft of the internal combustion engine. The two-stage planetary gear device includes two stages with ring gears and respective braking devices assigned to the two stages that prevent the ring gears of those stages from rotating when engaged therewith. The two-stage planetary gear device operates with different gear ratios in the starter mode and the generator mode. The gear ratio in the starter mode is between 4 and 60 and between 1.6 and 4 in the generator mode. The ratio of the gear ratios in the starter mode and the generator mode must be at least two.

27 Claims, 9 Drawing Sheets

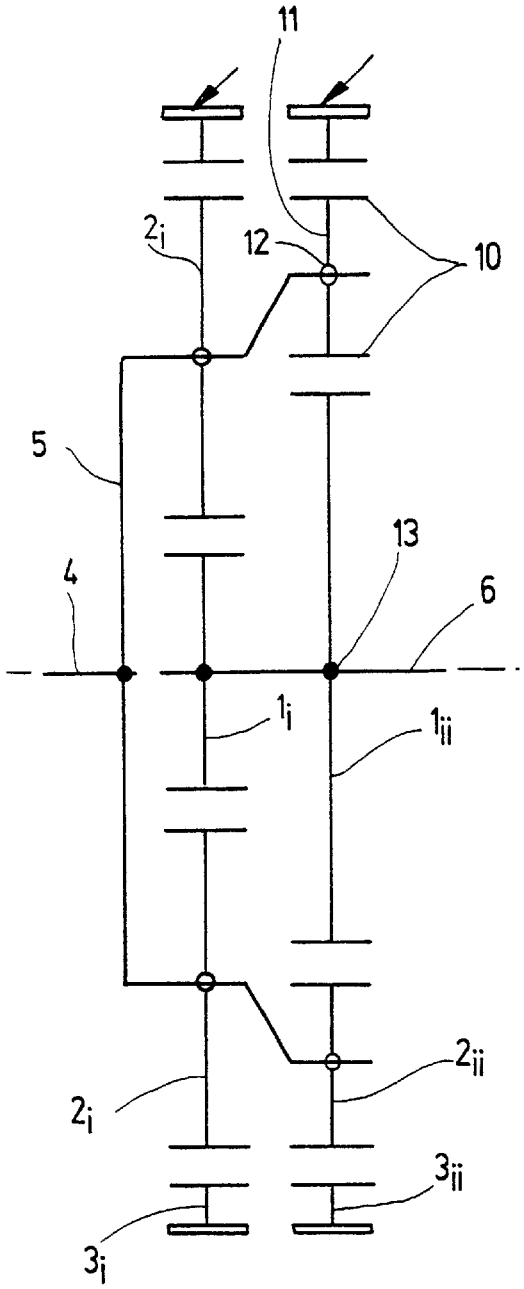
Fig. 1
Fig. 2
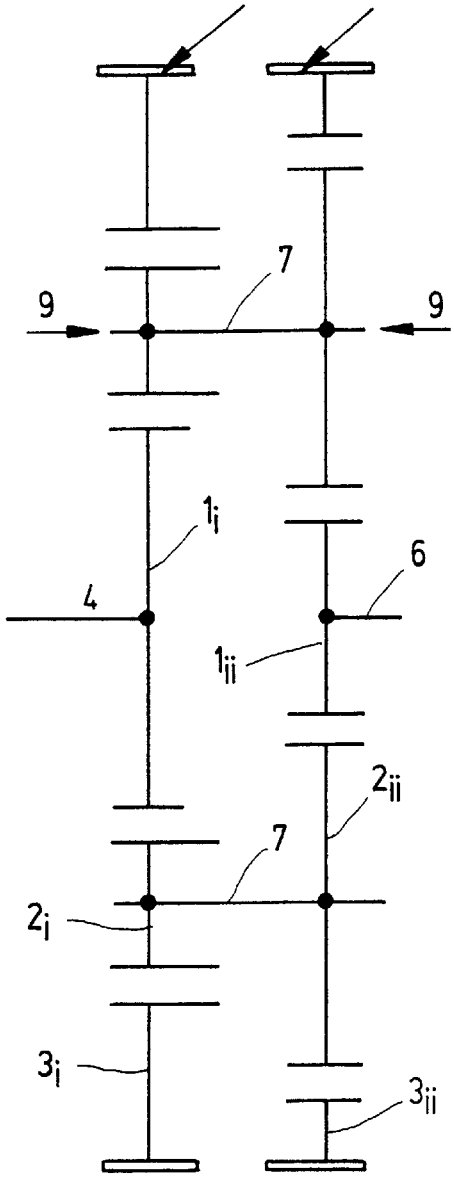

Fig. 7
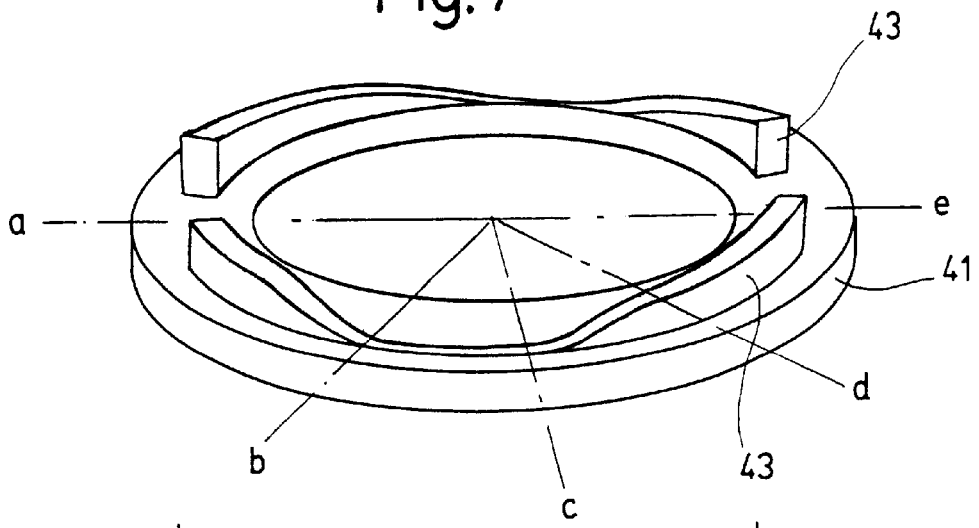
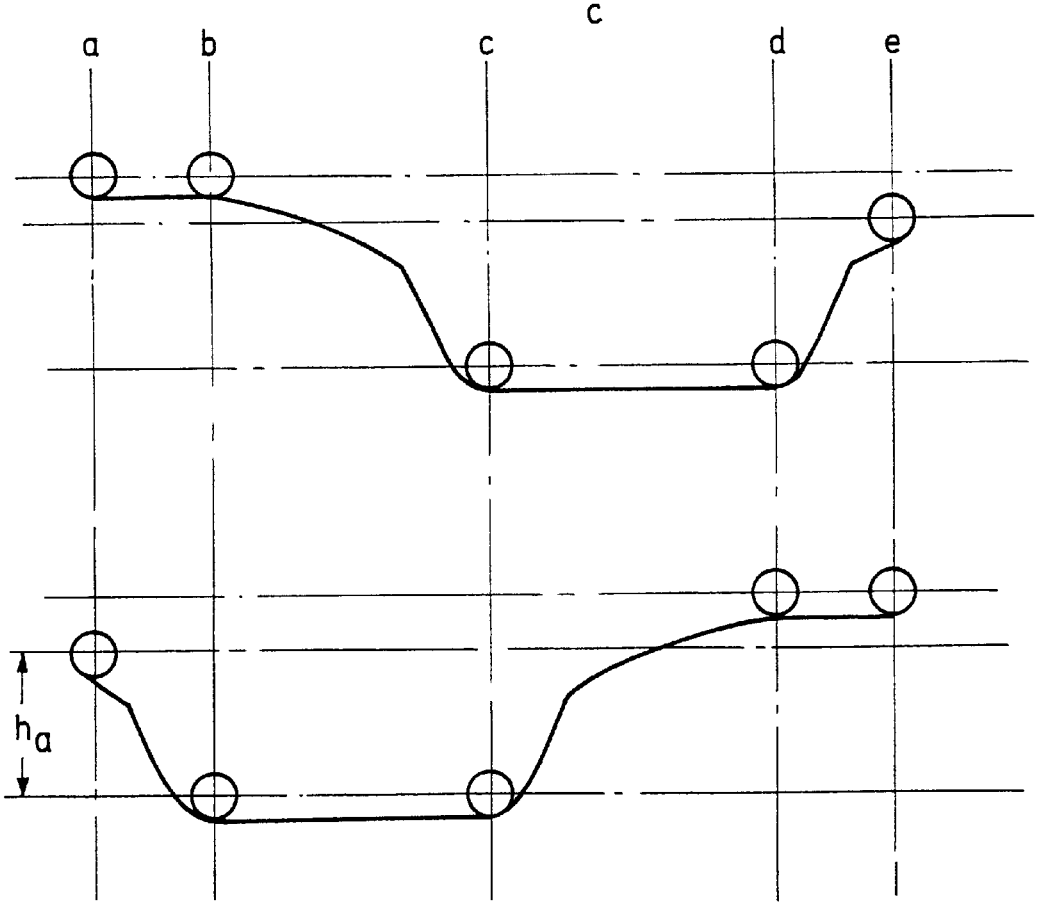
Fig. 8

ELECTRIC MOTOR WITH DRIVE

BACKGROUND OF THE INVENTION

1. Field of the Invention

The present invention relates to an electrical machine, which is reversible as a starter and generator for an internal combustion engine, especially an internal combustion engine of a motor vehicle. Such machines have been developed because they make it possible to unite the two functions of starting the engine and generating electrical current, which is needed. for the on-board systems of a vehicle, such as ignition, lighting, and so forth, in a single electrical machine and thus to save both weight and expense.

2. Description of the Related Art

In such electrical machines, however, the problem arises that for the generator mode and the starter mode of the electrical machine, different gear ratios are needed, so that a reversible gear must be provided that makes it possible to generate these different gear ratios in accordance with whichever function of the electrical machine is required just at that time.

A two-stage planetary gear is known from German Patent Disclosure DE 36 04 395. This reference teaches the use of such a gear in an automatic transmission of a motor vehicle for setting various gear ratios that correspond to the various gears, that is, speeds, in gear shifting and act on the chassis of the motor vehicle. The force transmission is always in the same direction here, namely from the engine to the chassis. This reference provides no information on the starter or the generator of the vehicle.

Another example of a two-stage planetary gear is known from German Patent Disclosure DE 19 531 043 A1. The planetary gear discussed in this reference is intended to be driven by a motor, in particular a motor of an electrical power tool, such as a power drill, and is intended to drive a tool with an adjustable gear ratio. Only one of the two stages is assigned a locking device that can prevent any rotation of the ring gear of this stage.

SUMMARY OF THE INVENTION

It is an object of the present invention to provide an improved electrical machine for an internal combustion engine of the above-describe kind, which is switchable for operation as a starter or a generator of the internal combustion engine with simple means.

According to the invention the electrical machine is synchronous or asynchronous and is alternately operable as a starter or as a generator of the internal combustion engine. This electrical machine comprises a two-stage planetary gear device coupled to a shaft of the internal combustion engine, in which each stage includes a plurality of gears, and respective braking devices assigned to the two stages to halt a rotary motion therein. The two-stage planetary gear device includes means for operation with a different gear ratio in a starter mode than in a generator mode.

The electrical machine of the present invention, which alternately functions as a starter or a generator for an internal combustion engine, advantageously includes simple means for switchover between gear ratios optimally adapted to the operation of the electrical machine as a starter and as a generator respectively.

Desirable gear ratios, for example for the use of a claw pole machine (synchronous or asynchronous machine) as an electrical machine are a gear ratio range of 1.6 to 4 for the generator mode and 4 to 60 in the starter mode. The spread, that is, the ratio of the gear ratios to one another, should be at least 2.

The brake force can be exerted in a simple way, in particular by the engagement of a braking device with a ring gear of the planetary gear. Shoe brakes, lamination brakes or friction belt brakes can in particular be considered for the braking devices.

In a first preferred embodiment of the electrical machine, the planetary gear includes two sun wheels solidly connected to the engine shaft and two sets of planet wheels, each meshing with one of the sun wheels and with a ring gear, and the planet wheels of both sets are rotatably mounted on a planet carrier that in turn is solidly connected to a starter or generator shaft, in order to transmit a rotary motion to the generator shaft, or from the generator shaft to the planet carrier. In this construction, by braking one of the two ring gears, a rotary force can be transmitted between the sun wheel of the braked stage of the two-stage gear and the planet carrier, while the other stage rotates freely.

This construction makes an especially compact design possible, in which the dimensions of the two ring a gears are identical. This reduces the number of different components of the gear that are required and makes more-rational and more-economical production possible.

In a second preferred embodiment, the planetary gear includes two sun wheels, of which one is solidly connected to the engine shaft and one to the starter or generator shaft, and two sets of planet wheels, each meshing with one of the sun wheels and one of the ring gears. The planet wheels of the two sets are connected in pairs on a common axle in a manner fixed against relative rotation. In a variant of this embodiment, the ring gear of one stage can be omitted.

In a third preferred embodiment, the two-stage planetary gear includes two sun wheels, one of them solidly connected to the engine shaft and the other to a starter or generator shaft, and two sets of planet wheels, each meshing with one of the sun wheels; the planet wheels of the two sets mesh with one another in pairs. A planetary gear of this kind requires only one ring gear.

In the second and third embodiment, the second braking device preferably does not engage a ring gear but instead is arranged to block the planetary motion of the planet wheels, or in other words their rotation about the shafts.

To that end, the planet wheels of both sets are preferably mounted rotatably on a common planet carrier, and the second braking device engages this planet carrier.

To simplify the control of the planetary gear, a common adjusting device for actuating both braking devices is preferably provided, which has at least one working position in which the first braking device is open and the second is closed, one working position in which the second braking device is open and the first is closed, and an idling position in which both braking devices are open. These positions can be set or adjusted by a control element that is movable with one degree of freedom. This degree of freedom is preferably a rotation, so that the adjusting device can be actuated simply, for instance with the aid of arbitrary conventional electrical machines.

To assure a gentle transition between the two gear ratio states of the gear, each corresponding to one working position of the adjusting device, the adjusting device can preferably be moved past the idling position from one working position to the other.

It is also expedient that the adjusting device can be moved past one working position to a braking position, in which the braking device that is open in the working position begins to be braked. The term "begins to be braked" is understood to mean a state of the braking device in which the braking moment is other than zero, but is limited enough that an overload on the gear and the drive train is precluded. The complete closure of one braking device should be allowed by the adjusting device only whenever the other braking device is not also closed at the same time.

In a first preferred embodiment of the adjusting device, in which the braking devices are actuatable by adjusting motions parallel to one axle of the gear, the adjusting device includes two ramps, rotatable about this axle, for converting a rotary motion into an adjusting motion of the braking devices. To couple the actuation of the braking devices, it suffices for the two ramps to be connected in a manner fixed against relative rotation. An adjusting device of this kind is particularly suitable for use where lamination brakes are the braking devices.

In a second embodiment of the adjusting device, in which the braking devices are actuatable by an adjusting motion perpendicular to an axle of the gear, the adjusting device has at least one cam disk and levers, interacting with the cam disk, for converting a rotation of the cam disk into an adjusting motion of the braking devices. It is understood that each lever and thus each braking device may also be assigned its own cam disk. This embodiment is suitable in particular for use in conjunction with shoe brakes as the braking devices.

Further characteristics and advantages of the invention will become apparent from the ensuing description of exemplary embodiments.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which:

FIGS. 1, 2, 2*a* and 3 are diagrammatic views of respective embodiments of planetary gear devices of the electrical machine of the invention;

FIG. 7 is a perspective view of an adjusting ring of the brake adjusting device of FIG. 6, which ring has two ramps for shifting a lamination brake to different operation positions;

FIG. 8 is a graphical illustration showing the axial shifting of the lamination brakes as a function of the orientation of the adjusting ring;

DETAILED DESCRIPTION OF THE INVENTION

Figure 14:
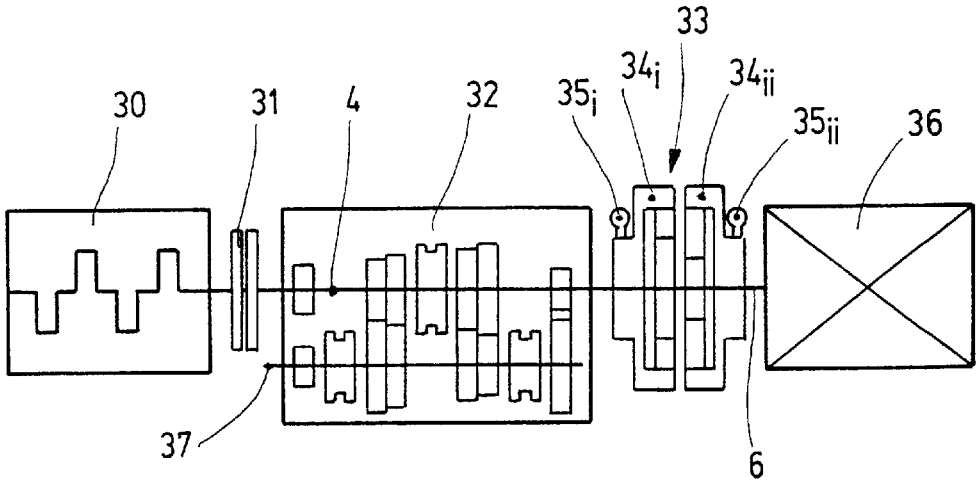
FIG. 14 is a schematic side view of the electrical machine of the invention arranged in the drive train of a motor vehicle.

As an overview, the disposition of an electrical machine of the invention in the drive train of a motor vehicle will first be briefly described in conjunction with FIG. 14. This drive train includes an internal combustion engine 30, which can be connected via a main clutch 31 to a gearbox 32, which drives wheels of the motor vehicle at various adjustable gear ratios via a power takeoff shaft 37. An engine shaft 4 passes through the gearbox 32 and is connected to the gear 33 of the electrical machine of the invention. The gear 33 is in two stages, and each gear stage $\mathbf{34}_i$, $\mathbf{34}_{ii}$ is assigned its own braking device $\mathbf{35}_i$, $\mathbf{35}_{ii}$. With the aid of the braking devices, the gear ratio between the shaft 4 and a shaft 6 that is connected to an electrical machine 36 can be adjusted. One of the two gear ratios of the gear 33 is intended for operation of the electrical machine 36 as a starter of the engine 30, and the other is intended for its operation as a generator.

Various features of gears 33 will now be described in conjunction with FIGS. 1, 2, 2A and 3.

First, with reference to FIG. 1, the highly schematic type of illustration employed here will be explained in general. FIGS. 1–3 show highly schematic axial sections through gears. Short horizontal lines 10 each represent the teeth of a gear wheel. Two such lines are each connected by a vertical line 11, which represents the disk of the gear wheel. An outlined circle 12 in the middle of the line 11 indicates that the applicable gear wheel is freely rotatable about an axis, which is symbolized by a horizontal line extending through the circle 12. A closed round dot 13 represents a solid connection between the applicable gear wheel and is its axis.

In the transmission shown in FIG. 1, the engine is coupled via a shaft 4 to a planet carrier 5, which rotatably holds planet wheels $\mathbf{2}_1$, $\mathbf{2}_2$ of the two stages of the planetary gear. These planet wheels each mesh with a respective sun wheel $\mathbf{1}_i$ and $\mathbf{1}_{ii}$ and a respective ring gear $\mathbf{3}_i$ and $\mathbf{3}_{ii}$. The sun wheels are solidly mounted on a shaft 6 that is coupled to the electrical machine (not shown). To adjust a gear ratio, a braking device (not shown in FIG. 1) engages an outer face $\mathbf{8}_i$, $\mathbf{8}_{ii}$ of one of the ring gears $\mathbf{3}_i$, $\mathbf{3}_{ii}$ and prevents it from rotating, while the other ring gear of the two is freely movable. In this way, a driving force is transmitted from the shaft 4 to the shaft 6, or in the opposite direction, depending on whether the electrical machine is functioning as a starter or as a generator, by whichever of the two gear stages has its ring gear braked at that time. The planet wheels and ring gears of the respectively other stage run freely along. The direction of motion of the freely running ring gear varies depending on the gear ratio established, but in each case the course speed of the ring gear is relatively slight in comparison to that of a blocked ring gear in a one-stage planetary gear. The mass inertia of the two-stage planetary gear is therefore astonishingly slight, despite the fact that an increased number of components is involved compared to a one-stage gear, and it allows fast, low-wear switchover between different gear ratios.

Figure 4:
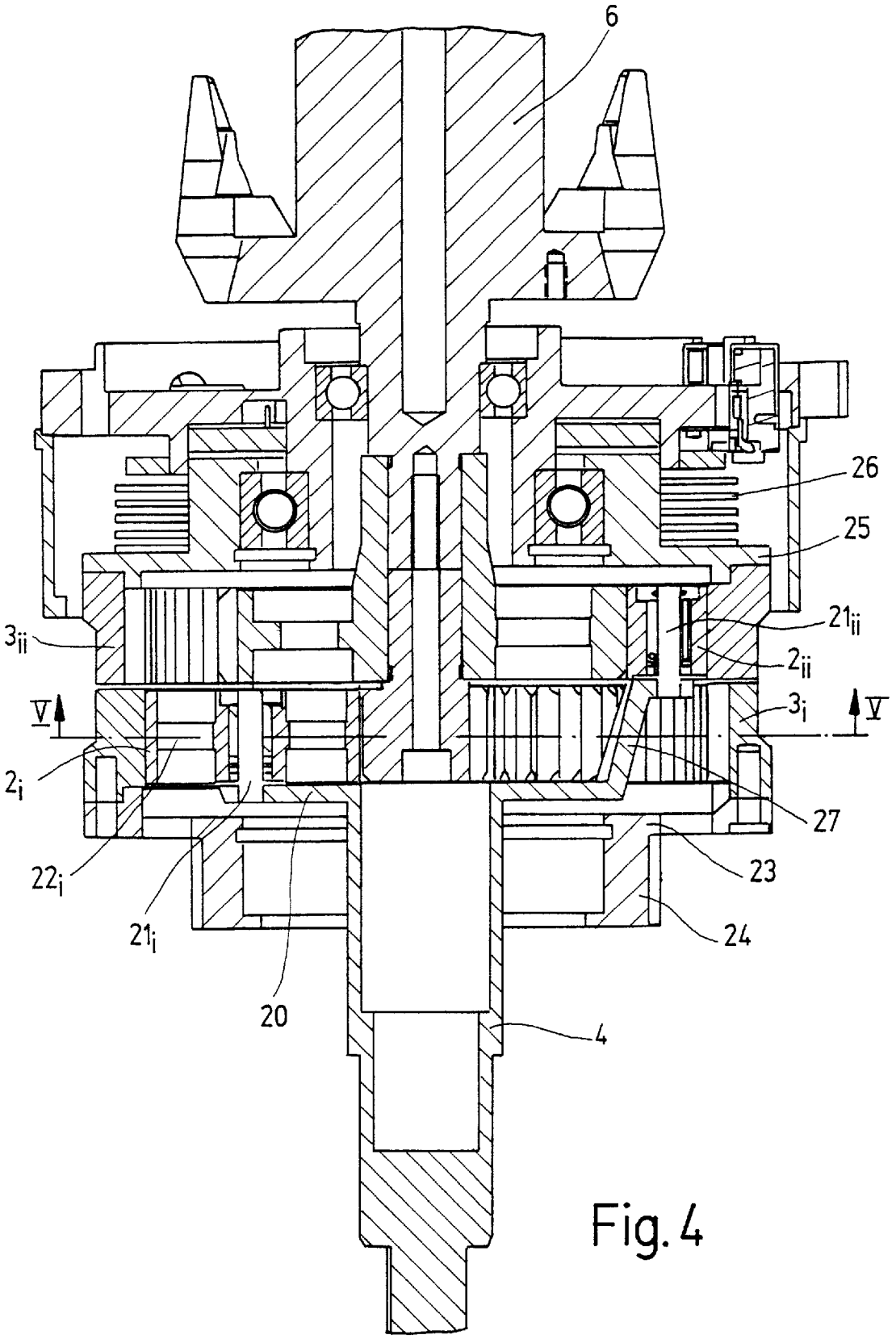
FIG. 4 is a longitudinal sectional view through a two-stage planetary gear device of a first embodiment.

FIG. 4, to illustrate the design of the two-stage planetary gear of FIG. 1, shows a detailed axial section. The shaft 4 connected to the engine has a planet carrier 20, in the form of a platelike flange, on the outer edge of which three pegs $\mathbf{21}_i$ (see also FIG. 5) are let in at an angular spacing of 120°; these pegs define the axes of rotation of the planet wheels $\mathbf{2}_i$ of the first gear stage. The disks $\mathbf{22}_i$ of the planet wheels $\mathbf{2}_i$ have only a fraction of the axial dimension of the teeth and furthermore are pierced, in order to keep the mass inertia of the wheels as slight as possible. The ring gear $\mathbf{3}_i$ is screwed to a flange 23, which has a cylindrical protrusion 24 serving as an engagement face for a braking device.

Diametrically opposite a peg $\mathbf{21}_i$, the planet carrier 20 has an arm 27, which protrudes past the axial width of the first gear stage and on whose end a further peg $\mathbf{21}_{ii}$ is anchored, which carries a respective planet wheel $\mathbf{2}_{ii}$ of the second gear stage. A flange 25 solidly joined to the ring gear $\mathbf{3}_{ii}$ forms a carrier for laminations 26 of a lamination brake.

Figure 5:
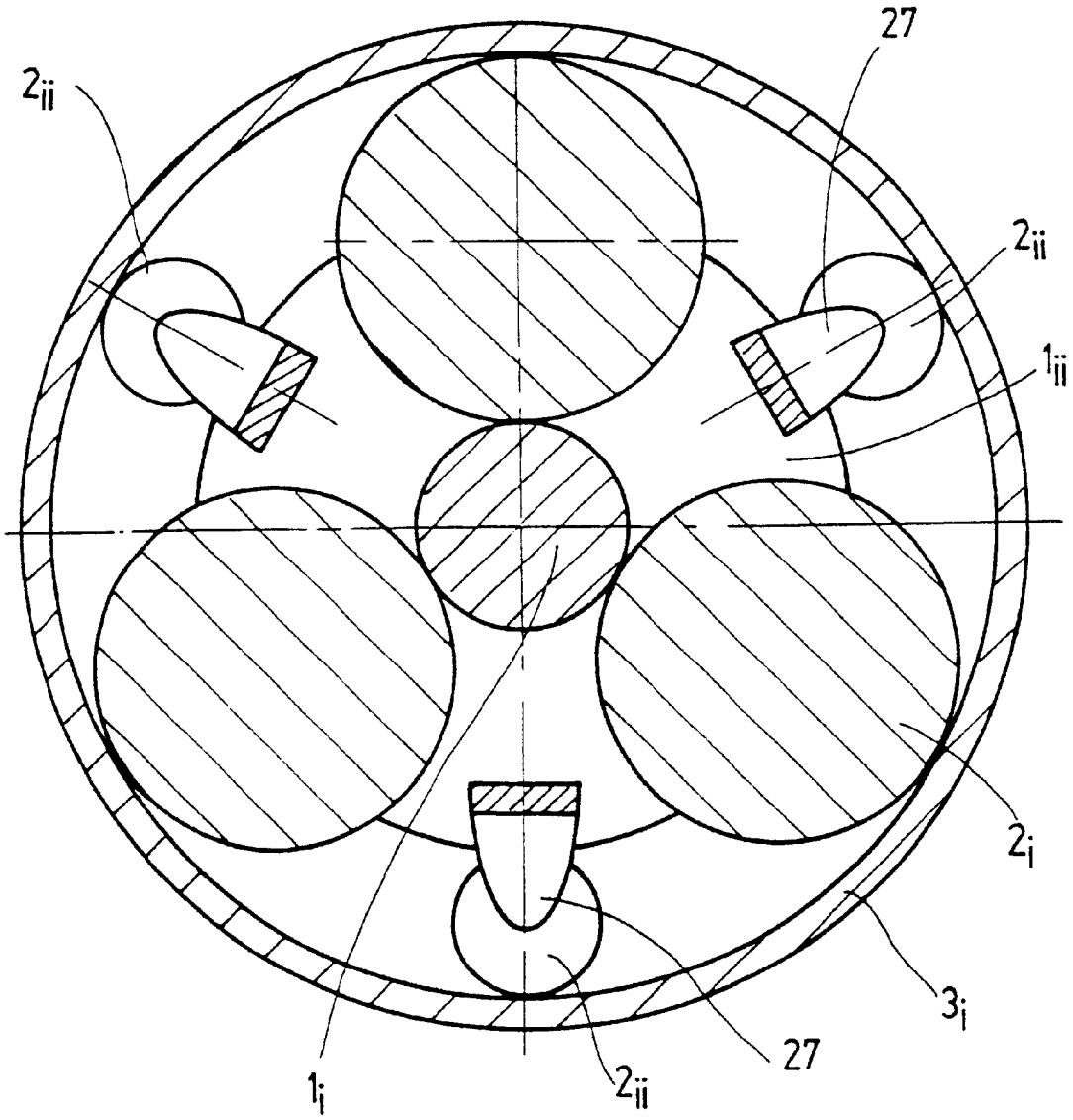
FIG. 5 is a section through the planetary gear device of FIG. 4 taken along the line V—V of FIG. 4.

FIG. 5 shows a simplified cross section along the line V—V of FIG. 4. The gear wheels $\mathbf{1}_i$, $\mathbf{2}_i$, $\mathbf{3}_i$ of the first stage are shown in section; the sun wheel $\mathbf{1}_{ii}$ is partly concealed. The arms 27 of the planet carrier 20, which hold the planet wheels $\mathbf{2}_{ii}$ of the second stage, extend through interstices between the planet wheels $\mathbf{2}_i$ of the first stage. The ring gear $\mathbf{3}_{ii}$ of the second stage is identical in its dimensions to the ring gear $\mathbf{3}_i$ of the first stage. The suns are marked $\mathbf{1}_i$ and $\mathbf{1}_{ii}$ in FIG. 5.

The gear ratios of the gear are represented by the formulas below:

$$U_i = \left(1 + \frac{Z_{3i}}{Z_{1i}}\right),$$

if the ring gear $\mathbf{3}_i$ is braked to a stop ($n_3$i), and $$U_{ii} = \left(1 + \frac{Z_{3ii}}{Z_{1ii}}\right)$$

if the ring gear $\mathbf{3}_{ii}$ is stopped ($n_3$ii=0), in which U stands for the gear ratio and Z stands for the number of teeth of a gear wheel.

As seen from Table 1 below, gear ratios $U_{ii}$ of approximately 2.5 for the second stage and $U_i$ of over 5 for the first, and spreads $\phi = U_i/U_{ii}$ of up to 3 and more are obtainable with even moderate numbers of teeth, no more than 75, for the ring gears. Lower gear ratios are also feasible in this construction, but they require large diameters of the ring gear and sun wheel, which goes counter to the goal of a compact construction.

TABLE 1

| $Z_{1ii}$ | $Z_{2ii}$ | $Z_{3ii}$ | $Z_{1i}$ | $Z_{2i}$ | $Z_{3i}$ | $U_{ii}$ | $U_i$ | $\phi$ |
|---|---|---|---|---|---|---|---|---|
| 45 | 11 | 67 | 11 | 28 | 67 | 2,48 | 7,09 | 2,70 |
| 47 | 11 | 69 | 11 | 29 | 69 | 2,46 | 7,27 | 2,94 |
| 47 | 11 | 69 | 13 | 28 | 69 | 2,46 | 6,80 | 2,55 |
| 47 | 11 | 69 | 15 | 27 | 69 | 2,46 | 5,60 | 2,26 |
| 47 | 11 | 69 | 17 | 26 | 69 | 2,46 | 5.05 | 2,04 |
| 47 | 13 | 73 | 11 | 31 | 73 | 2,55 | 7,63 | 2,99 |
| 47 | 13 | 73 | 13 | 30 | 73 | 2,55 | 6,61 | 2,59 |
| 47 | 13 | 73 | 15 | 29 | 73 | 2,55 | 5,86 | 2,29 |
| 49 | 11 | 71 | 11 | 30 | 71 | 2,44 | 4,45 | 3,04 |
| 49 | 11 | 71 | 13 | 29 | 71 | 2,44 | 6,46 | 2,63 |
| 49 | 11 | 71 | 15 | 28 | 71 | 2,44 | 5,78 | 2,34 |
| 49 | 13 | 5 | 13 | 31 | 75 | 2,53 | 5,76 | 2,67 |
| 49 | 13 | 75 | 15 | 30 | 75 | 2,53 | 6,00 | 2,37 |
| 49 | 13 | 75 | 17 | 29 | 75 | 2,53 | 5,41 | 2,13 |
| 51 | 11 | 73 | 11 | 31 | 73 | 2,43 | 7,68 | 3,14 |
| 51 | 11 | 73 | 13 | 30 | 73 | 2,43 | 6,64 | 2,72 |
| 51 | 11 | 73 | 15 | 29 | 73 | 2,43 | 6,86 | 2,41 |
| 51 | 11 | 73 | 17 | 28 | 73 | 2,43 | 5,29 | 2,17 |
| 51 | 11 | 73 | 19 | 27 | 73 | 2,43 | 4,84 | 1,99 |
| 51 | 13 | 77 | 13 | 32 | 77 | 2,50 | 6,92 | 2,75 |
| 51 | 13 | 77 | 15 | 31 | 77 | 2,50 | 6,18 | 2,44 |
| 51 | 13 | 77 | 17 | 30 | 77 | 2,50 | 5,52 | 2,20 |
| 51 | 13 | 77 | 19 | 29 | 77 | 2,50 | 5,05 | 2,01 |
| 53 | 11 | 75 | 11 | 32 | 75 | 2,41 | 7,81 | 3,23 |
| 53 | 11 | 75 | 13 | 31 | 75 | 2,41 | 6,76 | 2,80 |
| 53 | 11 | 75 | 15 | 30 | 75 | 2,41 | 6,00 | 2,48 |

TABLE 1-continued

| $Z_{1ii}$ | $Z_{2ii}$ | $Z_{3ii}$ | $Z_{1i}$ | $Z_{2i}$ | $Z_{3i}$ | $U_{ii}$ | $U_i$ | $\phi$ |
|---|---|---|---|---|---|---|---|---|
| 53 | 11 | 75 | 17 | 29 | 75 | 2,44 | 5,41 | 2,24 |
| 43 | 10 | 63 | 11 | 26 | 63 | 2,46 | 6,72 | 2,72 |
| 45 | 10 | 65 | 11 | 27 | 65 | 2,44 | 6,90 | 2,82 |
| 49 | 10 | 69 | 11 | 29 | 69 | 2,40 | 7,27 | 3,02 |
| 51 | 10 | 71 | 11 | 30 | 71 | 2,39 | 7,46 | 3,11 |

FIG. 2 shows the diagram of a second embodiment of a two-stage planetary gear for an electrical machine of the invention. In this construction, the shafts 4 and 6 connected to the engine and the electrical machine, respectively, are each solidly connected to a respective sun wheel $\mathbf{1}_i$ and $\mathbf{1}_{ii}$, planet wheels $\mathbf{2}_i$ and $\mathbf{2}_{ii}$ of the two stages are solidly coupled to one another by a common axle 7. In this construction, three different gear ratios can be established in principle, two of them by locking one ring gear each and the third by locking the planetary motion, or in other words stopping the axles 7 of the pairs of planet wheels.

The gear ratios are represented by the following formulas $$U_1 = \frac{Z_{1i}Z_{2ii}(Z_{1ii} + Z_{3ii})}{Z_{1ii}(Z_{2i}Z_{3ii} + Z_{1i}Z_{2ii})}, \quad n_{3ii} = 0$$

$$U_2 = \frac{Z_{1i}(Z_{2ii}Z_{3i} + Z_{1ii}Z_{2i})}{Z_{1i}Z_{2ii}(Z_{1ii} + Z_{3ii})}, \quad n_{3i} = 0$$

$$U_3 = \frac{Z_{1i}Z_{2ii}}{Z_{1ii}Z_{2i}}, \quad n_s = 0$$

in which $n_3$ii=0 and $n_3$i=0 mean that the respective ring gear $\mathbf{3}_{ii}$ and $\mathbf{3}_i$ is locked, and $n_s$=0 means that the planetary motion is stopped.

Examples of results for gear ratios $U_1$, $U_2$, $U_3$ and spreads $\phi$ for the various combinations of numbers Z of teeth of the individual gear wheels are listed in Table 2 below.

TABLE 2

| $Z_{1i}$ | $Z_{2i}$ | $Z_{3i}$ | $Z_{1ii}$ | $Z_{2ii}$ | $Z_{3ii}$ | $U_1$ $n_{3ii} = 0$ | $U_2$ $n_{3i} = 0$ | $U_3$ $n_s = 0$ | $\phi = U_2/U_1$ | $\phi = U_3/U_1$ |
|---|---|---|---|---|---|---|---|---|---|---|
| 53 | 11 | 75 | 29 | 35 | 99 | 2,78 | 3,82 | 5,81 | 1,37 | 2,09 |
| 55 | 10 | 75 | 36 | 29 | 94 | 2,27 | 2,97 | 4,43 | 1,31 | 1,95 |
| 53 | 9 | 71 | 33 | 29 | 91 | 2,45 | 3,39 | 5,17 | 1,38 | 2,11 |
| 53 | 10 | 73 | 33 | 30 | 93 | 2,40 | 3,21 | 4,81 | 1,33 | 2,00 |
| 53 | 11 | 75 | 33 | 31 | 95 | 2,37 | 3,06 | 4,52 | 1,29 | 1,90 |
| 53 | 9 | 71 | 35 | 27 | 89 | 2,27 | 3,02 | 4,54 | 1,33 | 2,00 |
| 53 | 12 | 77 | 31 | 34 | 99 | 2,52 | 3,27 | 4,84 | 1,29 | 1,91 |
| 53 | 12 | 77 | 33 | 32 | 97 | 2,33 | 2,94 | 4,28 | 1,26 | 1,83 |
| 55 | 11 | 77 | 33 | 33 | 99 | 2,50 | 3,33 | 5,00 | 1,33 | 2,00 |
| 55 | 10 | 75 | 35 | 30 | 95 | 2,35 | 3,14 | 4,71 | 1,33 | 2,00 |
| 55 | 9 | 73 | 35 | 29 | 93 | 2,39 | 3,31 | 5,06 | 1,38 | 2,11 |
| 55 | 10 | 75 | 36 | 29 | 94 | 2,27 | 2,97 | 4,43 | 1,31 | 1,95 |
| 57 | 10 | 77 | 37 | 30 | 97 | 2,31 | 3,08 | 4,62 | 1,33 | 2,00 |
| 57 | 11 | 79 | 37 | 31 | 99 | 2,27 | 2,94 | 4,34 | 1,29 | 1,90 |
| 59 | 10 | 79 | 39 | 30 | 99 | 2,26 | 3,02 | 4,53 | 1,33 | 2,00 |
| 49 | 10 | 69 | 35 | 24 | 83 | 1,97 | 2,38 | 3,36 | 1,20 | 1,70 |
| 49 | 10 | 69 | 33 | 26 | 85 | 2,14 | 2,67 | 3,86 | 1,24 | 1,80 |
| 49 | 10 | 69 | 31 | 28 | 87 | 2,32 | 3,00 | 4,42 | 1,28 | 1,90 |
| 49 | 10 | 69 | 29 | 30 | 89 | 2,53 | 3,37 | 5,06 | 1,33 | 2,00 |
| 49 | 10 | 69 | 30 | 29 | 88 | 2,42 | 3,18 | 4,73 | 1,31 | 1,95 |

It can be seen that the lowest gear ratios $U_1$ in each case are attained by stopping the ring gear $\mathbf{3}_{ii}$ of the second stage, since in this stage the diameter of the planet wheels $\mathbf{2}_{ii}$ is greater than that of the planet wheels $\mathbf{2}_i$ of the first stage. Whichever is the largest gear ratio is attained by stopping the axles 7. In this gear, it is therefore possible to dispense with the ring gear of the first stage, unless it is needed for mechanical stability of the gear.

For locking the motion of the axles 7 about the respective shafts 4 and 6, a braking device can be used that exerts a force in the axial direction, as represented by the arrows 9 in FIG. 2, on the ends of the axles 7, and the axles are thus prevented from executing a planetary motion, but the planet wheels are not prevented from rotating about the axles.

Figure 2A:
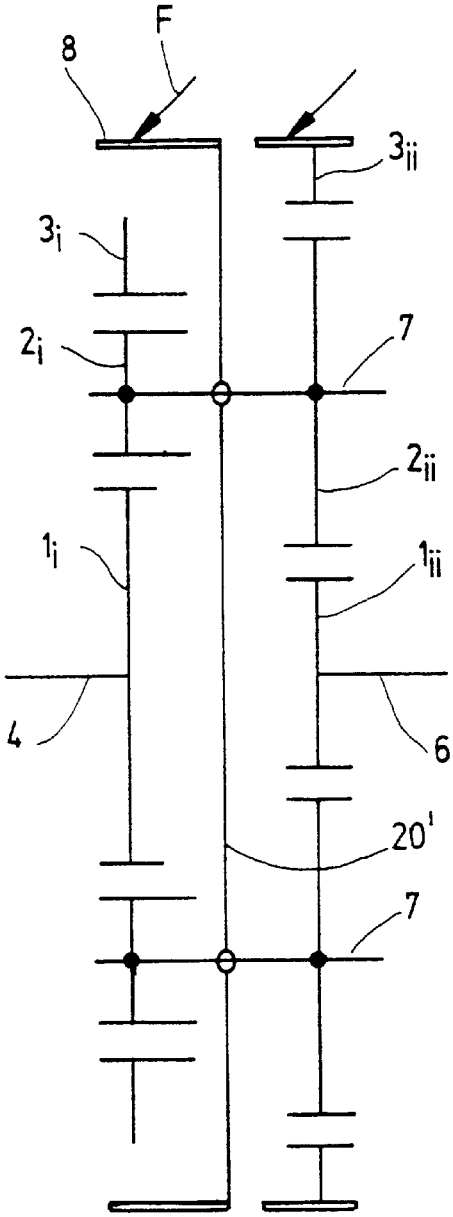
Figure 3:
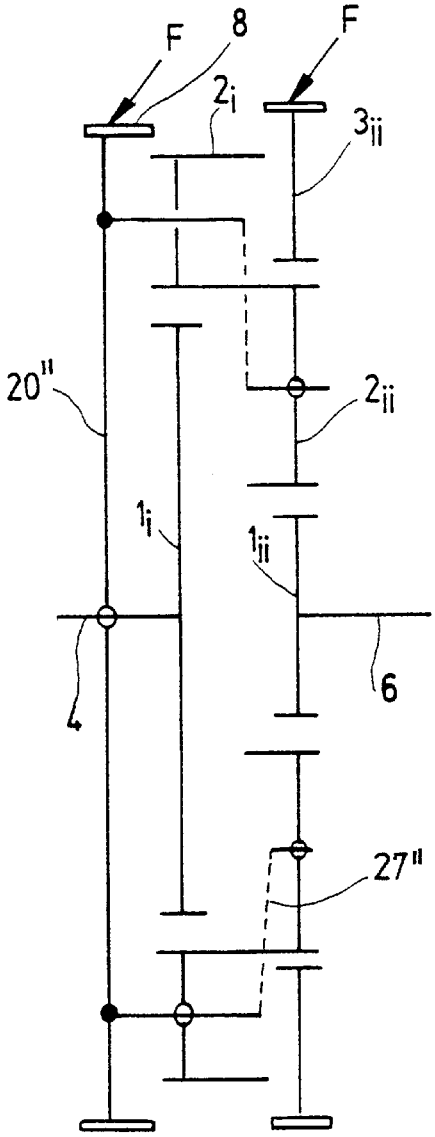

A modification is shown in FIG. 2*a*. A planet carrier 20' extends here between the two gear stages, and the axles 7 are retained in bores of the planet carrier 20'. In the same way as with the ring gears of the embodiments described in conjunction with FIGS. 1, 4 and 5 as well as 2, a brake force F engages a cylindrical outer face 8 that surrounds the edge of the planet carrier 20'. In this construction, braking devices of the same type can be used for both braking the motion of the axles 7 and braking the rotation of the ring gear $\mathbf{3}_{ii}$, which simplifies the construction.

In the embodiment of FIG. 3, the shaft 4 of the engine is solidly connected to a large sun wheel $\mathbf{1}_i$, which meshes with the planet wheels $\mathbf{2}_i$. The planet wheels are mounted rotatably on a planet carrier 20" and mesh with planet wheels $\mathbf{2}_{ii}$ of the second stage that are mounted on the same carrier 20". These planet wheels are in engagement with a small sun wheel $\mathbf{1}_{ii}$, which via a shaft 6 is coupled with an electrical machine intended as a starter and as a generator of the motor vehicle. The gear has two gear ratio states. In the first, the ring gear $\mathbf{3}_{ii}$ of the second stage is stationary, and in the second, it is the planet carrier 20" that is stationary. In the first stage, no ring gear is needed, which has a marked advantage in terms of compactness and mass inertia, since if this ring gear were present, it would have to be markedly larger and heavier than that of the second stage.

The planet carrier 20" holds the planet wheels $\mathbf{2}_{ii}$ of the second stage with the aid of arms, which extend partly outside the sectional plane of the drawing, with a double bend in the direction of the planetary motion, which is represented in the drawing by a dashed line.

The planet carrier 20", like the planet carrier 20' of FIG. 2A, can be stopped by a brake that engages a cylindrical outer face 8.

The table below shows gear ratios $U_1$, $U_2$ of the two gear ratio states for different numbers Z of teeth of the various wheels.

TABLE 3

| $Z_{1i}$ | $Z_{2i}$ | $Z_{1ii}$ | $Z_{2ii}$ | $Z_{3ii}$ | $U_1$ $n_s = 0$ | $U_2$ $n_{3ii} = 0$ | $\phi = U_1/U_2$ |
|---|---|---|---|---|---|---|---|
| 27 | 55 | 11 | 13 | 37 | 2,45 | 1,11 | 2,20 |
| 33 | 47 | 11 | 11 | 33 | 3,00 | 1,29 | 2,31 |
| 37 | 43 | 13 | 13 | 39 | 2,84 | 1,39 | 2,03 |
| 51 | 19 | 10 | 11 | 32 | 5,10 | 2,35 | 2,16 |
| 49 | 47 | 11 | 19 | 49 | 4,45 | 2,12 | 2,10 |
| 57 | 47 | 11 | 23 | 57 | 5,18 | 2,55 | 2,02 |
| 61 | 71 | 11 | 25 | 61 | 5,54 | 2,37 | 2,33 |
| 37 | 43 | 13 | 14 | 41 | 2,84 | 1,43 | 1,98 |
| 56 | 17 | 12 | 11 | 34 | 4,66 | 2,23 | 2,08 |
| 37 | 53 | 11 | 13 | 37 | 3,36 | 1,41 | 2,37 |
| 49 | 53 | 11 | 19 | 49 | 4,45 | 2,02 | 2,20 |
| 41 | 43 | 13 | 14 | 41 | 3,15 | 1,53 | 2,05 |
| 37 | 43 | 13 | 13 | 39 | 2,85 | 1,40 | 2,04 |
| 37 | 39 | 13 | 13 | 39 | 2,84 | 1,45 | 1,96 |
| 37 | 41 | 11 | 13 | 37 | 3,36 | 1,58 | 2,12 |
| 29 | 43 | 11 | 11 | 33 | 2,63 | 1,23 | 2,13 |

Once again, gear ratios in the suitable range and spreads of two or markedly higher can be attained with moderate numbers of teeth and consequently with a gear that is compact overall.

FIG. 5 in axial section shows a gear 33 with two lamination brakes $\mathbf{35}_i$, $\mathbf{35}_{ii}$ and an adjusting device for jointly actuating the two lamination brakes. The layout of the gear corresponds to that of FIG. 1 and will not described again in detail here. Each of the lamination brakes $\mathbf{35}_i$, $\mathbf{35}_{ii}$ includes one set of laminations connected to a ring gear $\mathbf{3}_i$, $\mathbf{3}_{ii}$ and a set of laminations connected to an axially displaceable carrier 40. The displaceable set of laminations is pressed by a spring (not shown) against an adjusting ring 41, which FIG. 7 shows in a perspective view. The adjusting ring 41 is axially fastened between the laminations and a set of stationary rollers 42 by the force of the spring.

As can be seen in FIG. 7, the adjusting ring 41 has two circumferentially extending ramps 43, on the surface of each of which a roller 42 rotates when the adjusting ring 41 is rotated about the shaft 4 or 6. Depending on the height of the ramps 43 at the points where they are in contact with the rollers 42, the lamination carriers 40 are shifted axially to different distances; that is, the brake is tightened variably markedly.

The two adjusting rings 41 are connected to a telescoping mechanism via a bridge 44 in such a manner that they are fixed against relative rotation but are axially displaceable relative to one another. One of the adjusting rings 41 on its outer circumference has a crown gear, which meshes with a pinion 45 that is driven by a motor 46 via a step-down gear 47. The crown gear extends over an angular segment whose size is at least equivalent to the angle defined by each ramp 43.

Figure 6:
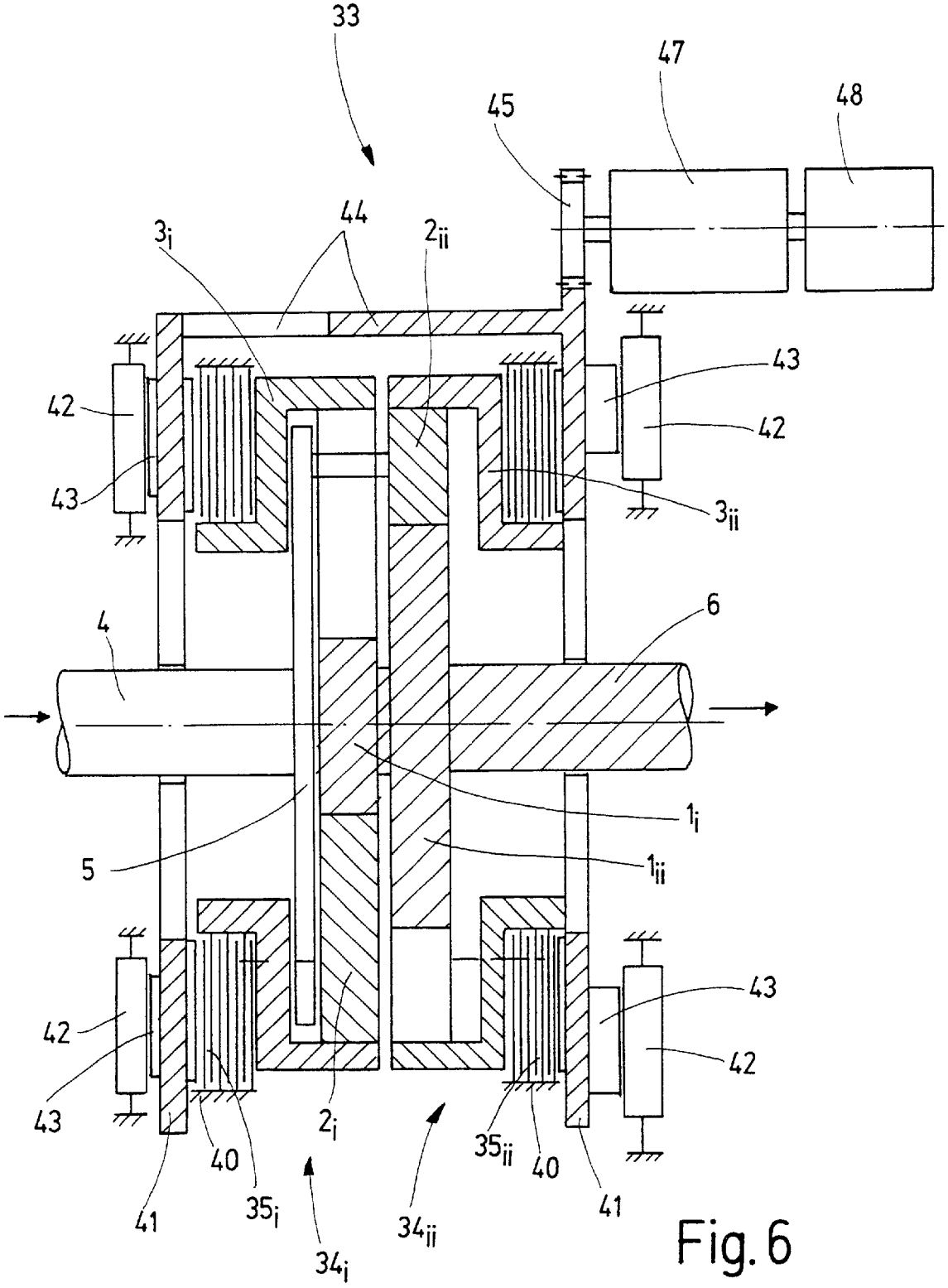
FIG. 6 is an axial sectional view through a planetary gear device of the electrical machine of the invention, having two lamination brakes and a common adjusting device for the two lamination brakes.
Figure 9:
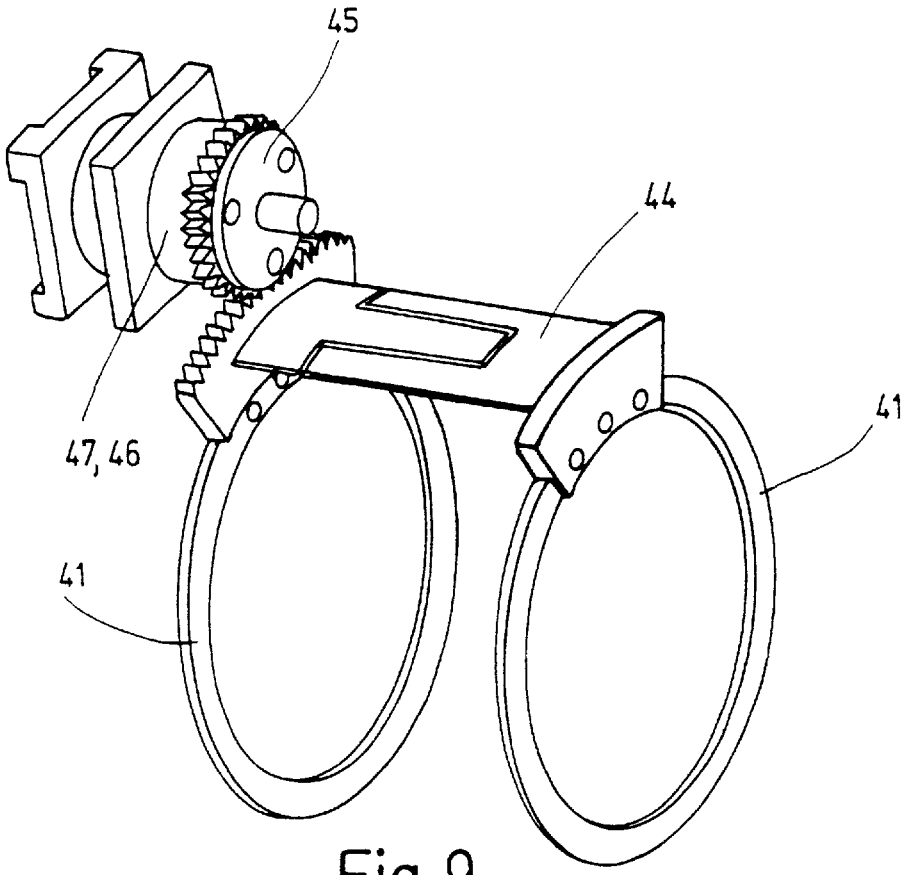
FIGS. 9 and 10 are respective perspective and side views of an adjusting device for jointly adjusting the two lamination brakes of the embodiment of FIG. 7.

FIG. 9 shows a perspective view of the adjusting device of FIG. 6 and of the gear motor arrangement 46, 47. The crown gear has the form of a segment 48 mounted solidly on an adjusting ring 41, and the bridge 44 to the second adjusting ring 41 also originates at this segment. The bridge 44 comprises two intermeshing elements guided axially by rails.

The components 41–45 and 48 can all be seen as a unit-type adjusting device that by simple rotation of the pinion 45 makes it possible to put the braking devices $\mathbf{35}_i$, $\mathbf{35}_{ii}$ in coupled fashion into different positions.

Which positions the braking devices each assume jointly depends on the design of the ramps 43.

FIG. 8 shows one example for a possible course of the height of the ramps 43 of the two adjusting rings 41 of FIG. 6 along their circumference. The lower curve corresponds to the adjusting ring shown in FIG. 7. Positions corresponding to one another for the adjusting ring 41 in FIGS. 7 and 8 are identified by the letters a–e. The circles at the curves in the positions a–e each symbolize the roller 42, assigned to the ramp, in various positions of its course. In a first position a, the ramp of FIG. 7 has a height $h_a$ (see the lower curve in FIG. 8), in which the associated braking device does perform braking but does not block completely. In positions b and c and the region between them, the braking device is open; between d and e, the brake force increases, until the brake is closed at d; between e and d the height of the ramp is constant. The course of the ramp associated with the other braking device, which is shown in the upper curve in FIG. 8, is mirror-symmetrical to this. Thus in position c, both braking devices are open, and the gear 33 is in an idling state. By rotation in the direction of position d, one braking device is gradually closed, while the other remains open. This state is a working state of the gear at one of the two possible gear ratios. By rotation in the opposite direction to position b, the second gear ratio is established. Rotations beyond positions b, d each lead to states in which one braking device is closed and the other brakes the entire drive train of the vehicle with a limited braking force.

Figure 10:
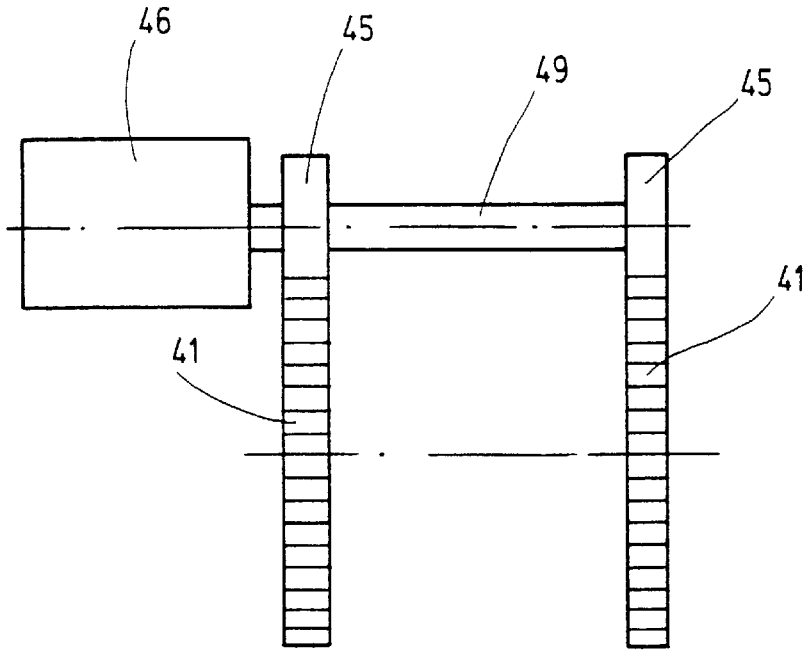

FIG. 10 schematically shows a variant of an adjusting device. Here, the adjusting rings 41 are both toothed on at least a portion of their outer circumference and they mesh with pinions 45, which are mounted on a common shaft 49 and are driven by the motor 46. The width of the pinions and of the teeth of the adjusting wheels 42 are dimensioned such that the adjusting wheels can be displaced axially, as a consequence of the interaction of the ramps (not shown in this Fig.) with the braking devices, yet without coming out of engagement with the pinions 45.

Further variants pertain to the number of ramps on one adjusting ring, which can readily be greater than two. It is also readily possible to dispose the ramps on the side of the adjusting rings toward the lamination carriers and thus to cause the ramps to interact directly with the lamination carriers, instead of axially displacing the entire adjusting ring 41 with the aid of the stationary rollers 42 as shown in FIG. 6.

Figure 11:
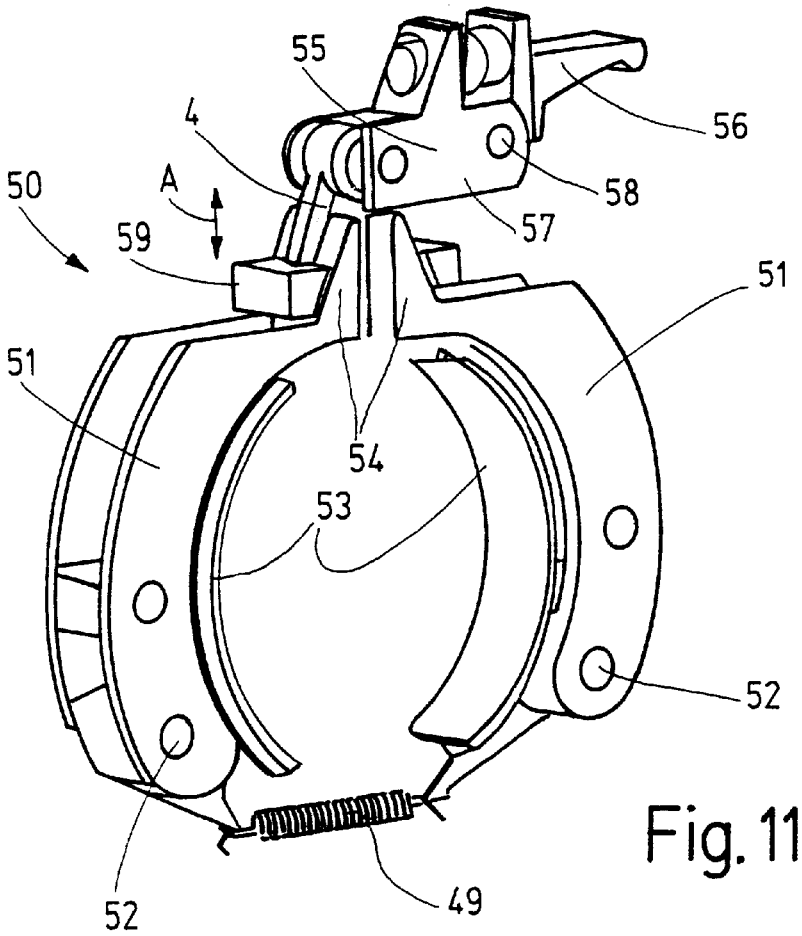
FIG. 11 is a perspective view of a shoe brake.

A second embodiment of a braking device, in the form of a shoe brake, is shown in FIG. 11. This shoe brake, identified by reference numeral 50, includes two arms 51, which are pivotable about shafts 52 that are stationary with respect to the gear 33 (not shown here). Each arm 51 carries one shoe brake 53. A tension spring 49 exerts a force on the arms 51 that acts in the direction of opening of the brake.

Figure 12:
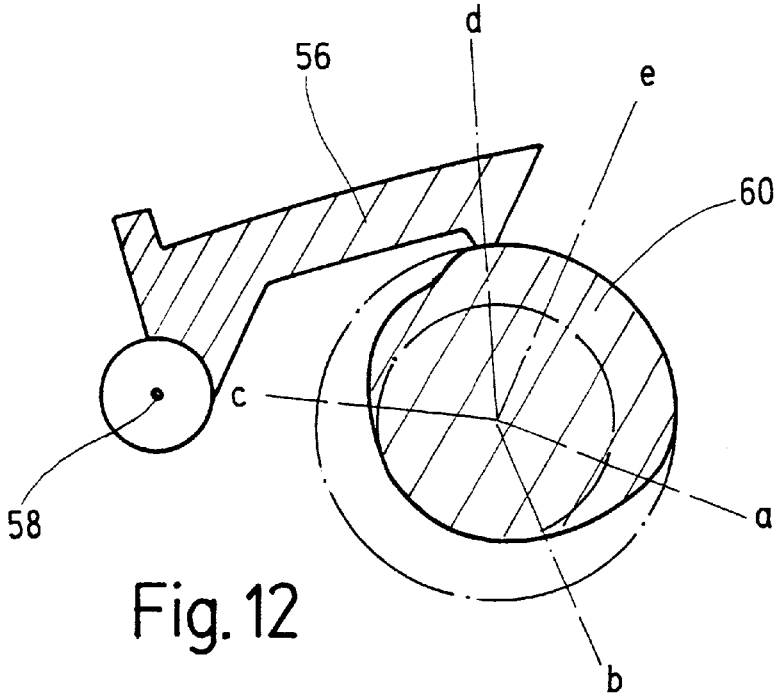
FIG. 12 is a schematic plan view showing the cooperation of the shoe brake with a control element.

On their ends, the arms 51 have opposed triangular protrusions 54 tapering to a point. An adjusting lever 55 is pivotable about a stationary shaft 58 and on a first arm 57 has a slide 59 with a recess, the inside of which the protrusions 54 engage. The slide 59 is movable perpendicular to the axis of the gear, in the direction of the arrow A, by a pivoting motion of the adjusting lever 55. The second arm 56 of the adjusting lever 56 cooperates, as shown in FIG. 12, with a cam disk 60 and thus determines the height of the slide 59 on the protrusions 54. To make the profile of the cam disk more apparent, a dot-dashed circle is drawn about its center of rotation; the radius of this circle is equal to the maximum radius of the cam disk. The farther downward the slide 59 is pressed in FIG. 1, the more strongly do the brake shoes 53 press against the ring gear (not shown), disposed between them, of the gear. The cam disk 60 (like the adjusting ring of the embodiments described above) can assume positions that are designated in FIG. 12 by letters a–e and that correspond in the same way as the states described above to states in which the shoe brake 50 is open, closed, or beginning to be braked.

Figure 13:
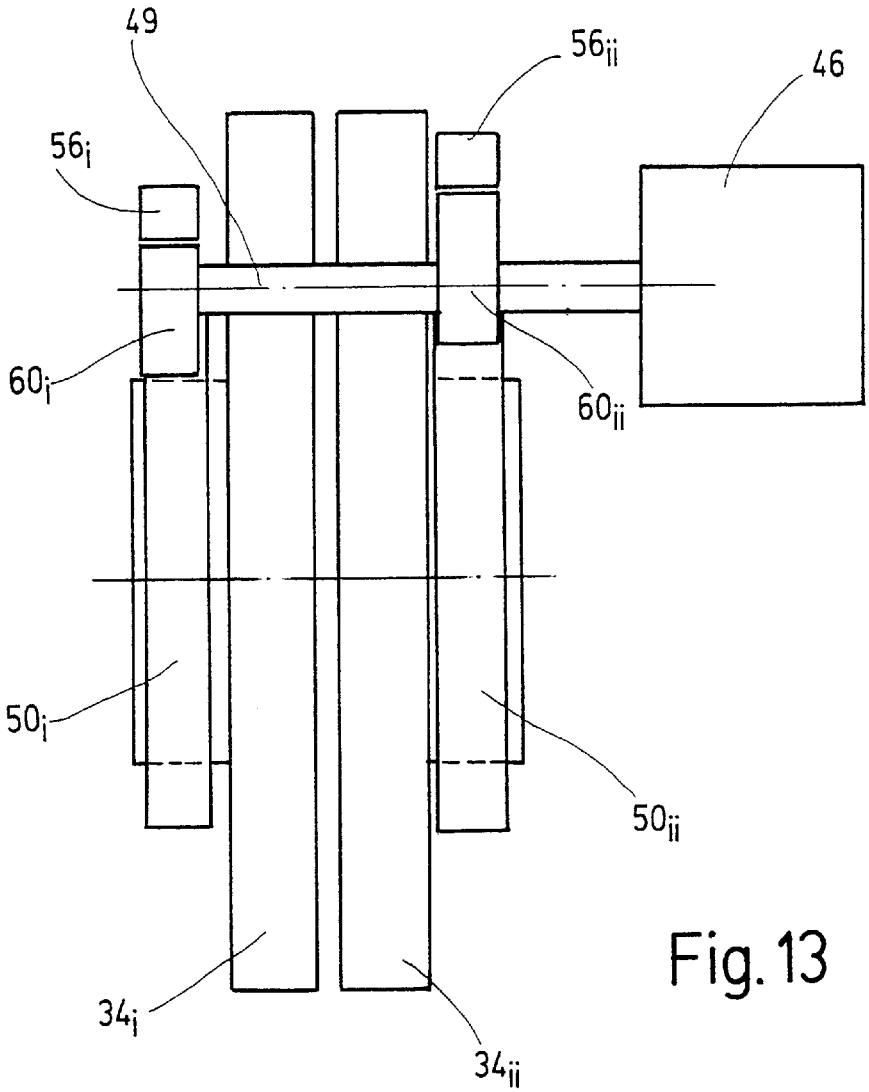
FIG. 13 is a side view of a two-stage planetary gear device according to the invention that is equipped with two shoe brakes as in FIG. 11 and an adjusting device as in FIG. 12.

FIG. 13 shows a side view of a gear 33 with two shoe brakes $\mathbf{50}_i$, $\mathbf{50}_{ii}$ of the design described above, which are assigned respectively to the two stages $\mathbf{34}_i$, $\mathbf{35}_{ii}$ of the gear. Two cam disks $\mathbf{60}_i$, $\mathbf{60}_{ii}$ are connected to a control motor 46 via a common shaft 49. The two cam disks are shaped identically but disposed in mirror symmetry to one another, so that in the position in FIG. 13, a second lever $\mathbf{56}_i$ is lowered, while the associated shoe brake $\mathbf{50}_I$ is thus open, and the other, second lever arm $\mathbf{56}_{II}$ is raised, and accordingly the shoe brake $\mathbf{50}_{ii}$ is closed.

In this embodiment, each adjusting lever is assigned its own cam disk $\mathbf{60}_I$, $\mathbf{60}_{II}$. Alternatively, it would also be possible to have the two adjusting levers engage the same cam disk with angular staggering.

What is claimed is:

1. A synchronous or asynchronous electrical machine for an internal combustion engine, said electrical machine being reversible for operation as a starter or as a generator of the internal combustion engine, wherein said electrical machine comprises a two-stage planetary gear device coupled to a shaft of the internal combustion engine, said two-stage planetary gear device comprising two stages, and respective braking devices assigned to the two stages for braking the two stages to halt a rotary motion therein;

wherein said two-stage planetary gear device includes means for operation with a predetermined gear ratio of 4 to 60 in a starter mode and with a predetermined gear ratio of 1.6 to 4 in a generator mode, said predetermined gear ratio in said generator mode is different from said predetermined gear ratio in said starter mode and a ratio of said gear ratio in said starter mode to said gear ratio in said generator mode is at least two.

2. The synchronous or asynchronous electrical machine as defined in claim 1, wherein at least one of said two stages includes a ring gear and the braking device assigned to said at least one of said two stages engages with said ring gear.

3. The synchronous or asynchronous electrical machine as defined in claim 2, wherein each of said respective braking devices is a shoe brake, a lamination brake or a friction belt brake.

4. The synchronous or asynchronous electrical machine as defined in claim 1, wherein said two stages comprise respective sun wheels, respective ring gears and respective sets of planet wheels meshing with said sun wheels and said ring gears, said sun wheels are rigidly attached to a starter or generator shaft, said planet wheels of said two stages are rotatably mounted on respective planet carriers and said respective planet carriers are rigidly mounted on said shaft of the internal combustion engine.

5. The synchronous or asynchronous electrical machine as defined in claim 4, wherein said respective gears are identical.

6. The synchronous or asynchronous electrical machine as defined in claim 4, wherein said shaft of said internal combustion engine has a rotation speed substantially equal to a rotation speed of said internal combustion engine.

7. The synchronous or asynchronous electrical machine as defined in claim 1, wherein said two stages include respective ring gears and said respective braking devices engage with said respective ring gears.

8. The synchronous or asynchronous electrical machine as defined in claim 1, wherein said two-stage planetary gear device includes two sun wheels, one of which is rigidly connected to the shaft of the internal combustion engine and another of which is rigidly connected to a starter or generator shaft, and respective sets of planet wheels meshing with corresponding ones of said two sun wheels.

9. The synchronous or asynchronous electrical machine as defined in claim 8, wherein said two-stage planetary gear device includes at least one ring gear and pairs of the planet wheels of said two stages are non-rotatably connected to a common axle.

10. The synchronous or asynchronous electrical machine as defined in claim 9, wherein one of the respective braking devices includes means for blocking rotation of said planet wheels around said shafts.

11. The synchronous or asynchronous electrical machine as defined in claim 10, wherein each of said planet wheels of said two stages is rotatably mounted on a common planet carrier.

12. The synchronous or asynchronous electrical machine as defined in claim 10, wherein said one of said respective braking devices engages the common planet carrier.

13. The synchronous or asynchronous electrical machine as defined in claim 8, wherein said planet wheels of said two stages mesh with one another in pairs.

14. The synchronous or asynchronous electrical machine as defined in claim 13, wherein one of said respective braking devices includes means for blocking rotation of said planet wheels around said shafts.

15. The synchronous or asynchronous electrical machine as defined in claim 14, wherein each of said planet wheels of said two stages is rotatably mounted on a common planet carrier.

16. The synchronous or asynchronous electrical machine as defined in claim 15, wherein said one of said respective braking devices engages the common planet carrier.

17. The synchronous or asynchronous electrical machine as defined in claim 1, further comprising a common brake adjusting device for operating each of said braking devices and wherein said common brake adjusting device includes a control element having one degree of freedom and has a first working position in which a first of said braking devices is open and a second of said braking devices is closed, a second working position in which said first of said braking devices is closed and said second of said braking devices is open and an idling position in which both of said braking devices are open.

18. The synchronous or asynchronous electrical machine as defined in claim 17, wherein the common brake adjusting device moves from said first working position to said second working position or from said second working position to said first working position via said idling position.

19. The synchronous or asynchronous electrical machine as defined in claim 17, wherein the common brake adjusting device is movable from the first or second working position into a braking position in which the braking device that is open begins to be braked.

20. The synchronous or asynchronous electrical machine as defined in claim 17, wherein the common brake adjusting device permits closure of one of said braking devices only if another of said braking devices is not simultaneously closed.

21. The synchronous or asynchronous electrical machine as defined in claim 17, wherein said respective braking devices are actuated by adjusting motions parallel to an axis and the common brake adjusting device has two ramps, rotatable about said axis, for converting a rotary motion of the brake adjusting device into an adjusting motion of said braking devices.

22. The synchronous or asynchronous electrical machine as defined in claim 21, wherein said ramps of said common brake adjusting device are connected to each other so that said ramps cannot rotate relative to each other.

23. The synchronous or asynchronous electrical machine as defined in claim 21, or 22, wherein said respective braking devices are arranged along said axis, each of said braking devices being located between said two-stage planetary gear device and an associated one of said two ramps.

24. The synchronous or asynchronous electrical machine as defined in claim 17, wherein each of said braking devices comprises a lamination brake.

25. The synchronous or asynchronous electrical machine as defined in claim 1, wherein the respective braking devices are actuable by corresponding brake adjusting motions perpendicular to an axis of the two-stage planetary gear device and further comprising a brake adjusting device having at least one cam disk and levers interacting with the cam disk for converting a rotation of the cam disk into said brake adjusting motions.

26. The synchronous or asynchronous electrical machine as defined in claim 25, wherein each of said braking devices is a shoe brake.

27. The synchronous or asynchronous electrical machine as defined in claim 1, wherein said internal combustion engine is a motor of a motor vehicle.

* * * * *